US006450293B1

(12) United States Patent
Wu

(10) Patent No.: US 6,450,293 B1
(45) Date of Patent: Sep. 17, 2002

(54) FIRE ESCAPE DEVICE

(76) Inventor: Yi-Jia Wu, No. 50-14, Chung-Hsin Rd., Pu-Li Chen, Nan-Tou Hsien (TW)

( * ) Notice: Subject to any disclaimer, the term of this patent is extended or adjusted under 35 U.S.C. 154(b) by 0 days.

(21) Appl. No.: 09/984,232

(22) Filed: Oct. 29, 2001

(51) Int. Cl.[7] ..... A62B 1/16

(52) U.S. Cl. ..... 182/236; 182/7; 182/231; 182/71

(58) Field of Search ..... 182/231, 234, 182/236, 237, 239, 42, 7, 71

(56) References Cited

U.S. PATENT DOCUMENTS 437,091 A * 9/1890 Carr
728,145 A * 5/1903 Triplett
936,385 A * 10/1909 Thornburg
4,554,997 A * 11/1985 Sheu

* cited by examiner

*Primary Examiner*—Alvin Chin-Shue
(74) *Attorney, Agent, or Firm*—Liniak, Berenato, Longacre & White, LLC

(57) ABSTRACT

A fire escape device includes first and second cable drums rotatably mounted on a mounting shaft and spaced apart from each other axially, first and second support cables respectively wound around hub portions of the cable drums, and a coupling mechanism disposed between the cable drums to interconnect releasably the same. The first support cable is unreeled to generate a jerking force to permit rotation of the second cable drum with the first cable drum. Unreeling of the second support cable can rotate the first and second cable drums to reel the first support cable. Thus, alternately lowering people one after another from an elevated floor to a safe location can be achieved.

9 Claims, 11 Drawing Sheets

FIRE ESCAPE DEVICE

BACKGROUND OF THE INVENTION

1. Field of the Invention

This invention relates to a fire escape device, more particularly to a fire escape device which is adapted to be supported from a portion of a building structure for alternately lowering people one after another from an elevated floor to a safe location during an emergency situation.

2. Description of the Related Art

Many fire escape devices have been developed to assist people entrapped on elevated floors of a building to safely escape without injury. Some of these devices are difficult to operate in the dark and in emergency situations and cannot permit the rapid escape of people.

SUMMARY OF THE INVENTION

The object of the present invention is to provide a fire escape device which is adapted to be supported from a portion of a building structure for alternately and rapidly lowering people one after another from an elevated floor to a safe location during an emergency situation.

According to this invention, the fire escape device includes a mounting shaft secured relative to a portion of a building structure. The mounting shaft defines an axis and has left and right segments opposite to each other in an axial direction parallel to the axis, and an intermediate segment interposed therebetween. A first cable drum includes a first hub portion which is rotatably mounted on the left segment, and which has first left and right ends opposite to each other in the axial direction, and first left and right sidewalls which extend respectively from the first left and right ends outwardly and radially, and which are spaced apart from each other in the axial direction to confine, together with the first hub portion, a first wound region. The first right sidewall has first inner and outer lateral surfaces opposite to each other in the axial direction. A first support cable has a first winding segment to be wound around the first hub portion in the first wound region, a first leading end which extends from the first winding segment and which is adapted to be pulled by a first person on the building structure so as to unreel the first winding segment to rotate the first cable drum in a clockwise direction, thereby lowering the first person to the safe location, and a pulled end which extends from the first winding segment distal to the first leading end and which is loosely anchored relative to the first inner lateral surface and pullable in the axial direction. Immediately after the first support cable is unreeled from the first wound region, the pulled end will be actuated to generate a jerking force in the axial direction. A second cable drum includes a second hub portion which is rotatably mounted on the right segment and which has second left and right ends opposite to each other in the axial direction, and second left and right sidewalls which extend respectively from the second left and right ends outwardly and radially and which are spaced apart from each other in the axial direction to confine, together with the second hub portion, a second wound region. The second left sidewall has second inner and outer lateral surfaces opposite to each other in the axial direction. A second support cable has a second winding segment to be wound around the second hub portion in the second wound region, a second leading end which extends from the second winding segment and which is adapted to be pulled by a next person on the building structure so as to unreel the second winding segment to rotate the second cable drum in a counterclockwise direction, thereby lowering the next person to the safe location, and an anchoring end which extends from the second winding segment distal to the second leading end and which is anchored relative to the second inner lateral surface. A coupling mechanism includes a first coupling member which is disposed on the first outer lateral surface, and a second coupling member which is loosely secured to and which is movable relative to the second outer lateral surface in the axial direction so as to be rotated with the second cable drum about the axis. The second coupling member is sleeved on and is movable relative to the intermediate segment in the axial direction between an engaging position, where the second coupling member is moved to engage the first coupling member so as to rotate with the first cable drum, and a disengaged position, where the second coupling member is retracted to be closer to the second outer lateral surface in the axial direction, thereby disengaging the first coupling member. A biasing member is disposed between the second coupling member and the second outer lateral surfaces to bias the second coupling member to move to the engaging position. A blocking member is disposed on the first outer lateral surface and is movable in response to an axially jerking movement of the pulled end between a blocking position, where the blocking member prevents the second coupling member from engaging the first coupling member against the biasing action of the first biasing member, and an unblocked position, where the blocking member is steered out of the course which permits the engagement between the first and second coupling members.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
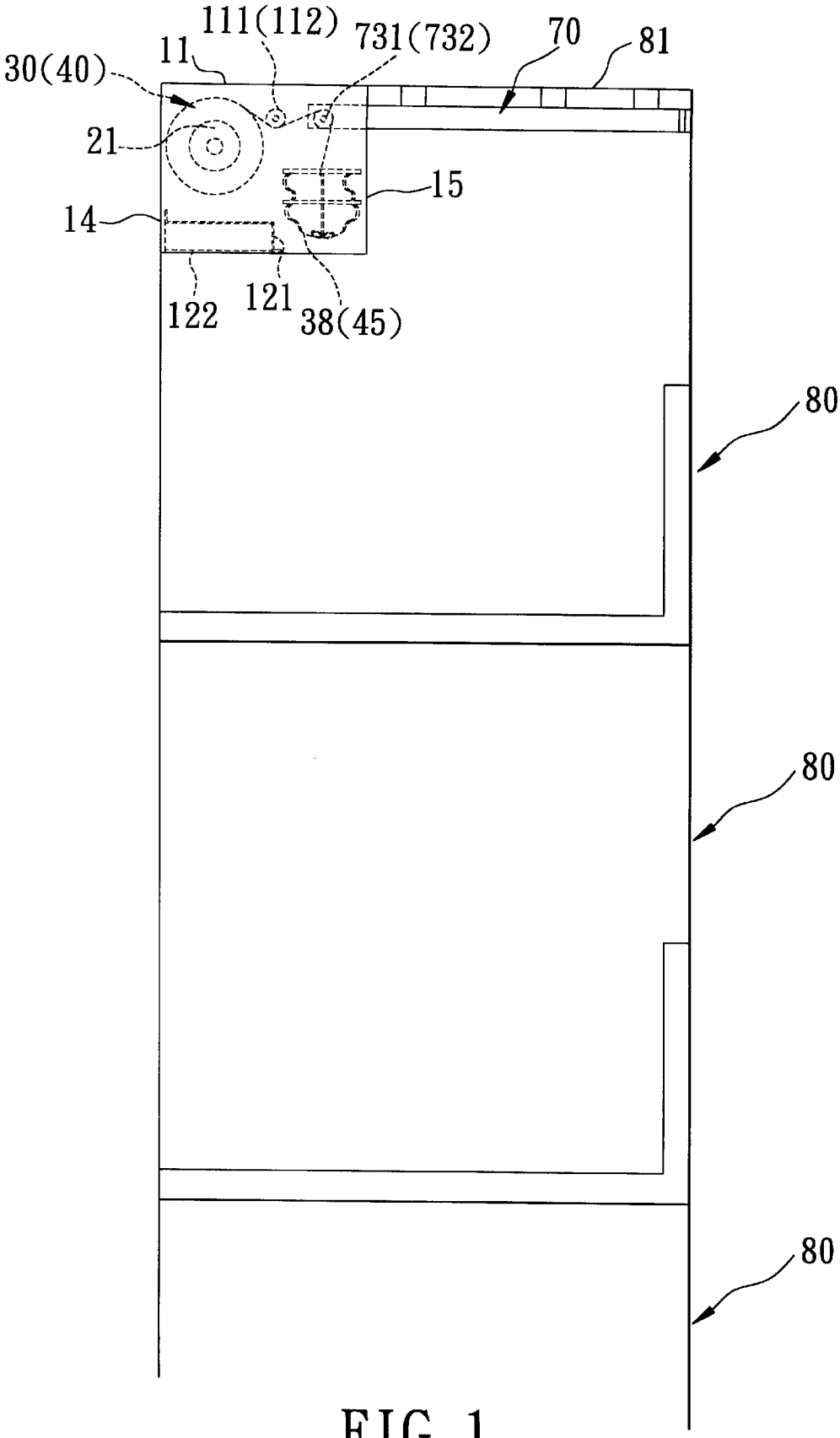
FIG. 1 is a side schematic view of the preferred embodiment of a fire escape device according to this invention when mounted on a sill of a building.
Figure 2:
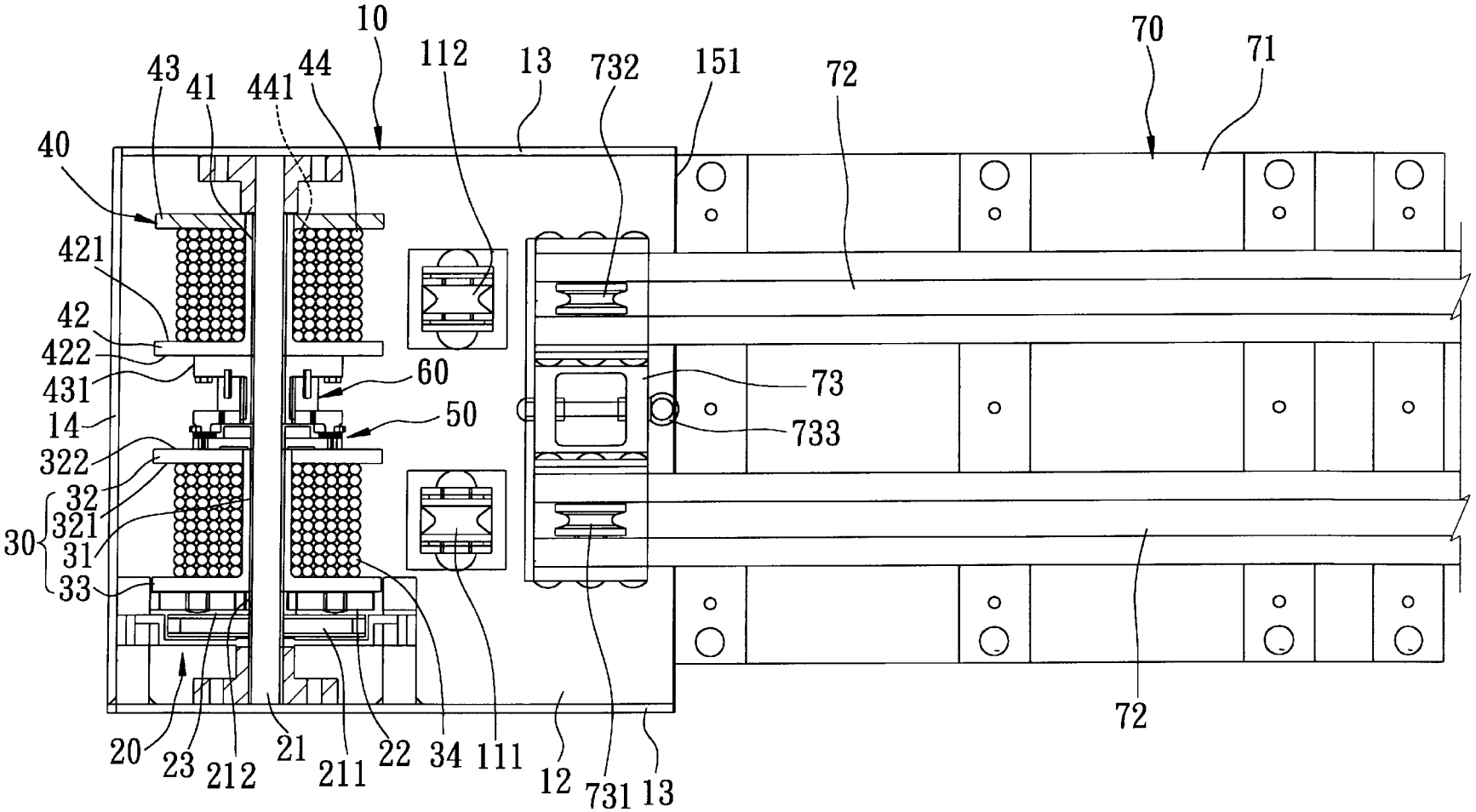
FIG. 2 is a top schematic view of the embodiment, a top wall of a casing thereof being removed for the sake of clarity.

Referring to FIGS. 1 and 2, the preferred embodiment of the fire escape device according to the present invention is shown to be mounted on a top wall 81 of a sill 80 of a building, and comprises a casing frame 10 which includes top, bottom, right and left walls 11,12,13, a back wall 14, and a pivot front wall 15. An illuminating member 121 and a light-emitting plate 122 are mounted on the bottom wall 12.

A mounting shaft 21 is secured to the right and left walls 13, and defines an axis. The mounting shaft 21 has left and right segments which are disposed opposite to each other in an axial direction parallel to the axis, and an intermediate segment which is interposed between the left and right segments.

Figure 4:
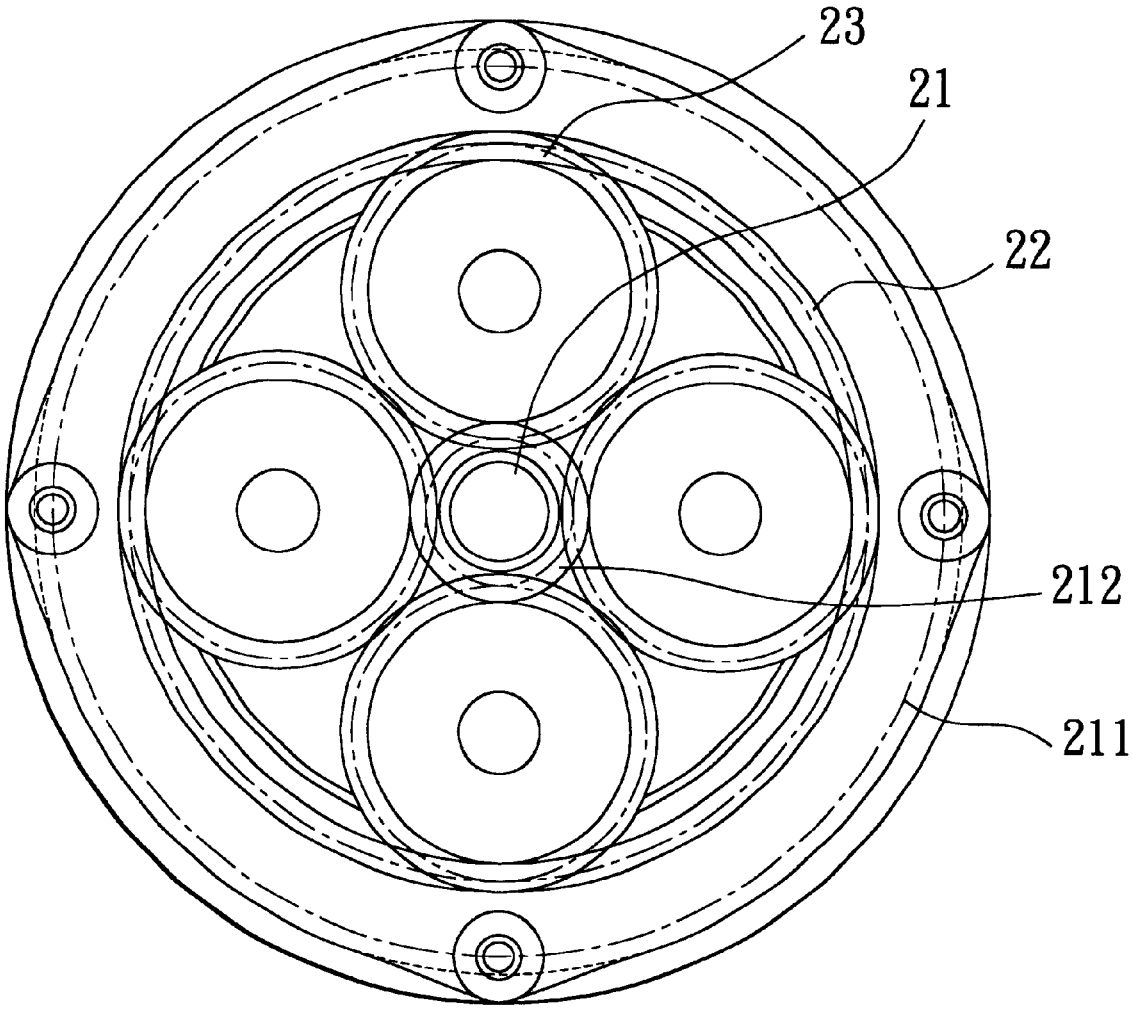
FIG. 4 is a side schematic view of a speed reduction gear mechanism of the embodiment.

With reference to FIG. 4, a speed reduction mechanism 20 includes a planet carrier 22 secured to the left wall 13, a planetary gear assembly 23 meshing with the planet carrier 22, a sun gear 212 disposed on the mounting shaft 21 and meshing with the planetary gear assembly 23, and a ring gear 211 surrounding the mounting shaft 21.

Figure 3:
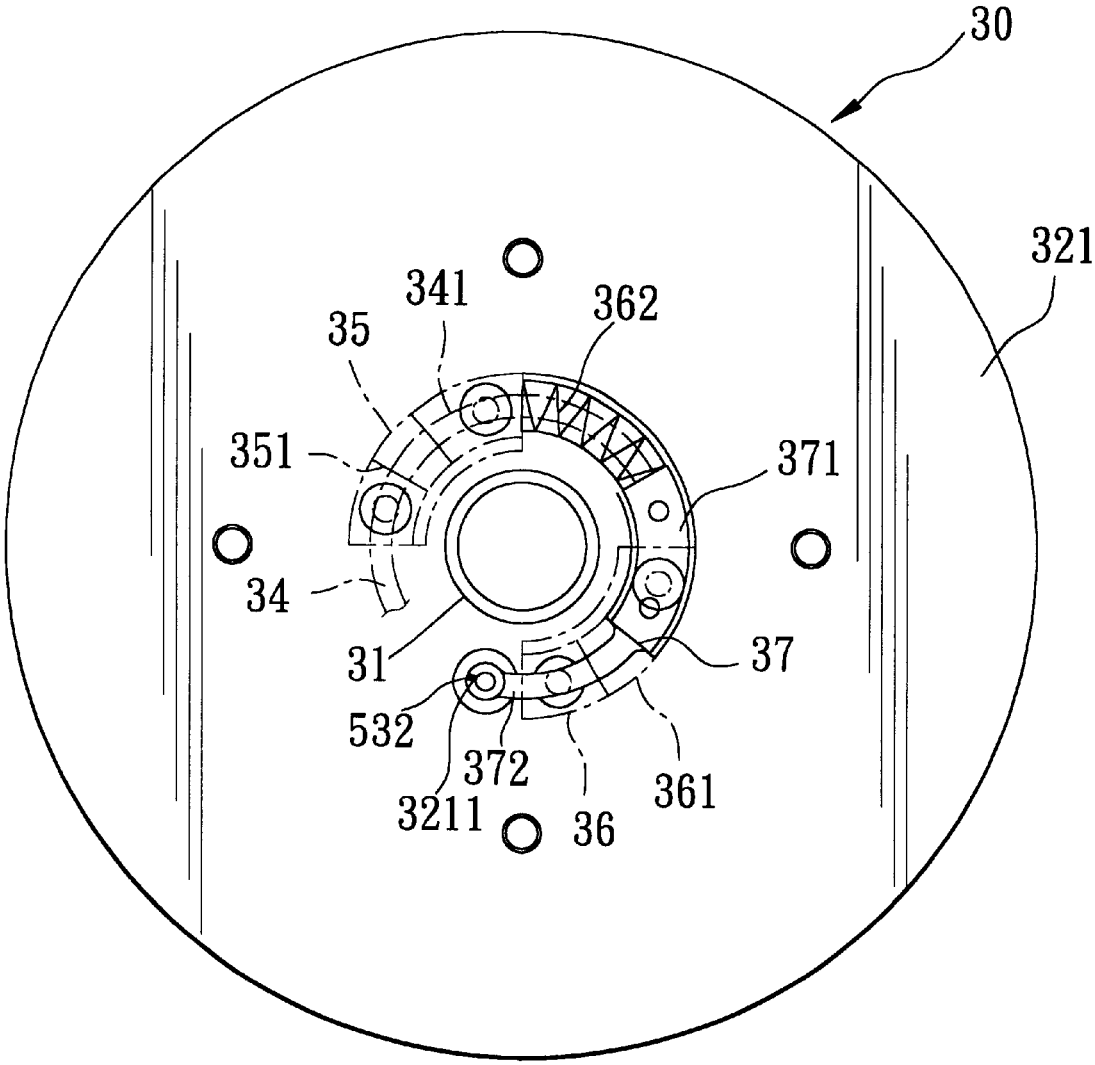
FIG. 3 is a side schematic view of a first cable drum of the embodiment.
Figure 8:
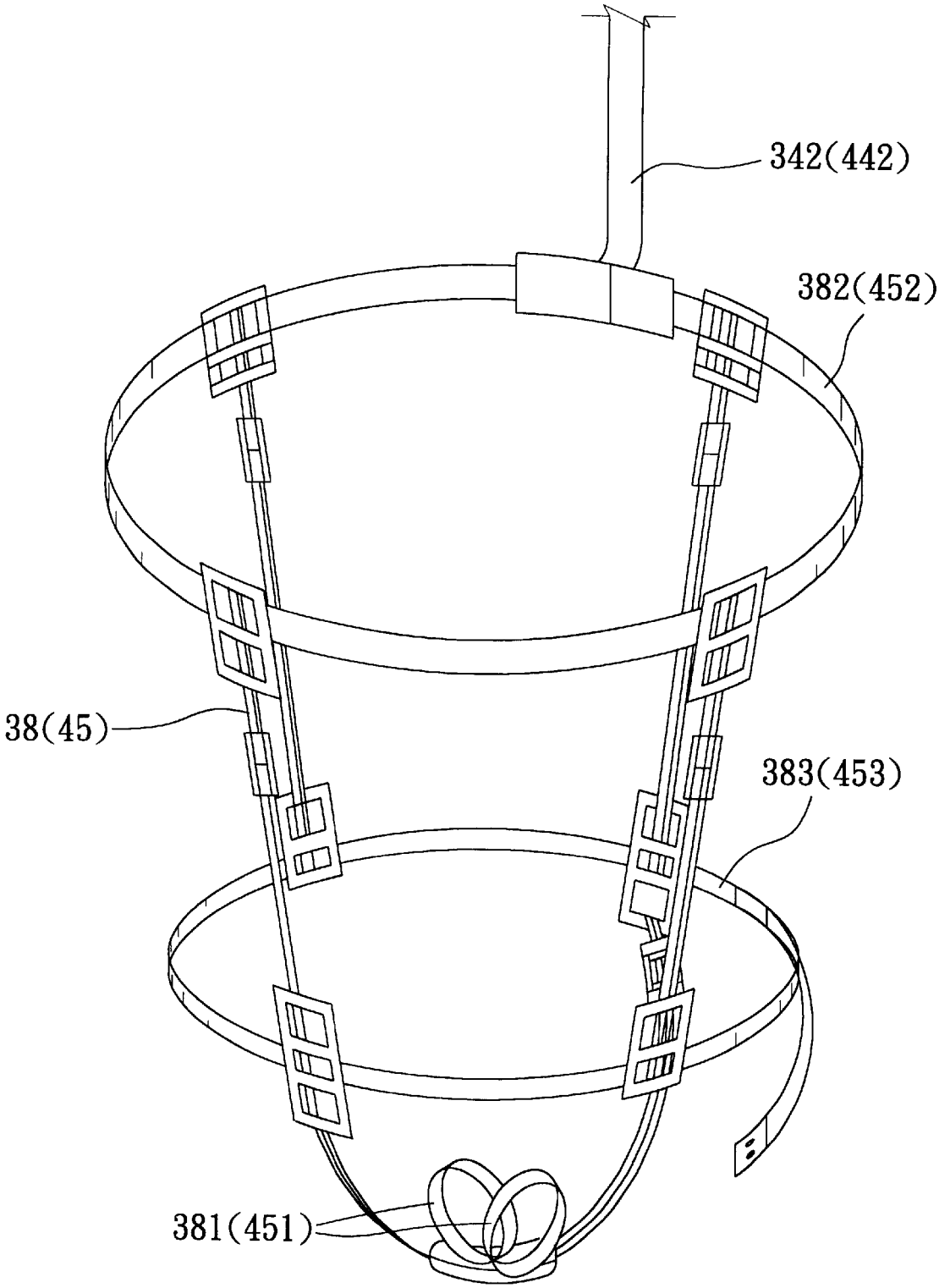
FIG. 8 is a perspective view of a seat basket of the embodiment.

With reference to FIGS. 2, 3 and 8, a first cable drum 30 includes a first hub portion 31 which is rotatably mounted on the left segment of the mounting shaft 21, and which has first left and right ends opposite to each other in the axial direction, and first left and right sidewalls 33,32 which extend respectively from the first left and right ends of the first hub portion 31 outwardly and radially, and which are spaced apart from each other in the axial direction to confine, together with the first hub portion 31, a first wound region. The first right sidewall 32 has first inner and outer lateral surfaces 321,322 opposite to each other in the axial direction. A first support cable 34 has a first winding segment to be wound around the first hub portion 31 in the first wound region, a first leading end 342 (as shown in FIG. 8) which extends from the first winding segment, and a pulled end 341 which extends from the first winding segment distal to the first leading end 342 and which is loosely anchored on the first hub portion 31 to be pullable in the axial direction. Two lug seats 35,36 are disposed on the first inner lateral surface 321, and have two through slots 351, 361 formed therein. An arcuate connecting head 37 is disposed on and is movable relative to the first inner lateral surface 321 around the axis between the through slots 351,361. The connecting head 37 has a first connecting end 371 which engages the pulled end 341 of the first support cable 34 that extends through the through slot 351, and a second connecting end 372 which is displaced angularly opposite to the first connecting end 371 and which extends through the through slot 361 so as to engage a first cord end of a cord 532. A biasing member 362 is disposed between the first connecting end 371 and the lug seat 35 to bias the connecting head 37 toward the lug seat 36. A second cord end 5321 of the cord 532 extends through a through hole 3211 formed in the first inner lateral surface 321 and extending through the first outer lateral surface 322.

A second cable drum 40 includes a second hub portion 41 which is rotatably mounted on the right segment of the mounting shaft 21 and which has second left and right ends opposite to each other in the axial direction, and second left and right sidewalls 42,43 which extend respectively from the second left and right ends of the second hub portion 41 outwardly and radially and which are spaced apart from each other in the axial direction to confine, together with the second hub portion 41, a second wound region. The second left sidewall 42 has second inner and outer lateral surfaces 421,422 opposite to each other in the axial direction. A second support cable 44 has a second winding segment to be wound around the second hub portion 41 in the second wound region, a second leading end 442 (as shown in FIG. 8) which extends from the second winding segment, and an anchoring end 441 which extends from the second winding segment distal to the second leading end 442 and which is anchored to the second hub portion 41. Referring to FIG. 8, two seat baskets 38,45 are connected respectively to the first and second leading ends 342,442 for accommodating people. Each seat basket 38,45 has two openings 381,451 formed in lower portions thereof, and protecting and fastening belts 382,452,383,453.

Figure 5:
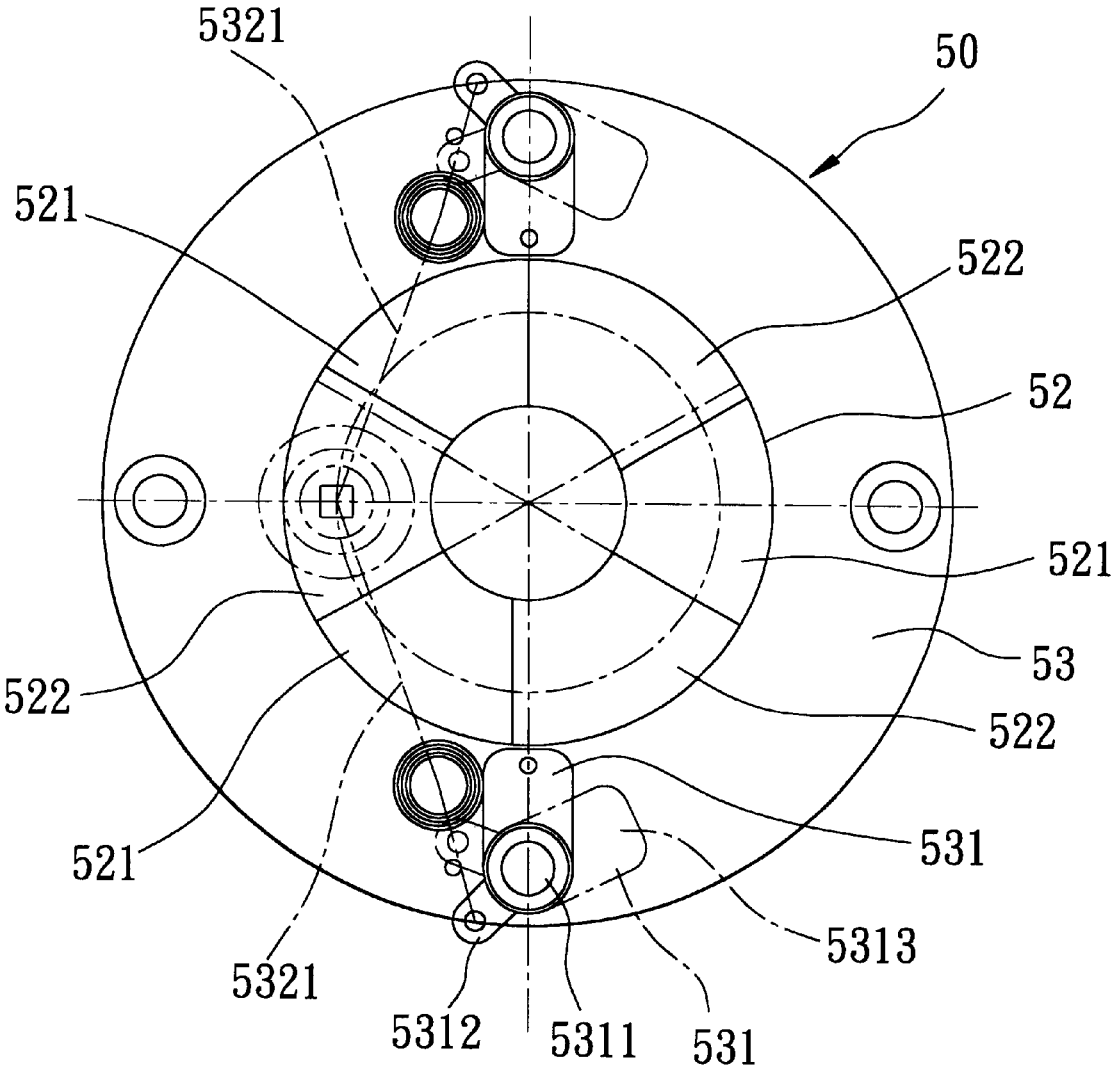
FIG. 5 is a side schematic view of a first coupling member of the embodiment.
Figure 7:
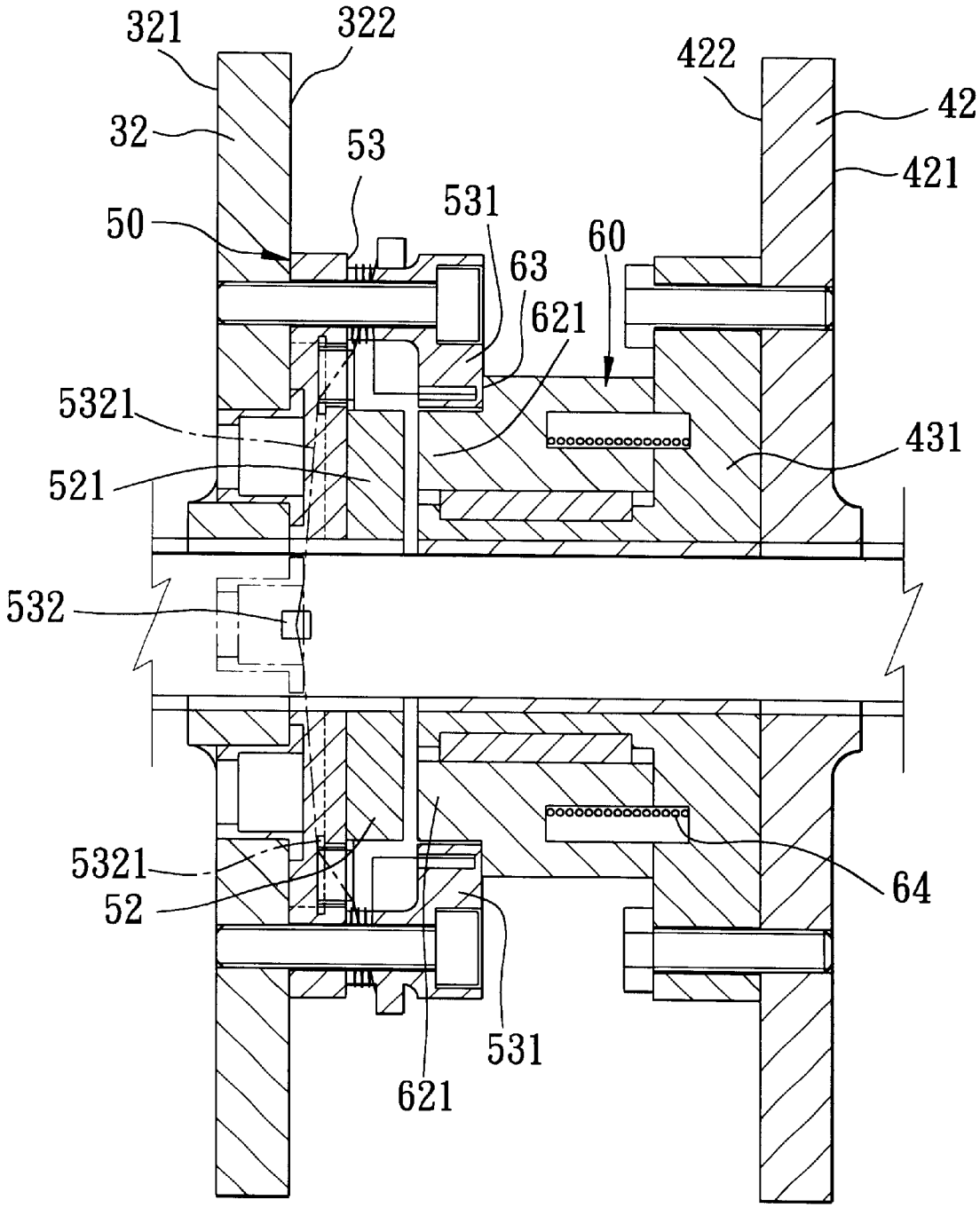
FIG. 7 is a sectional schematic view to illustrate blocking members in a blocking position.

A coupling mechanism is disposed on the intermediate segment of the mounting shaft 21, and includes first and second coupling members 50,60. With reference to FIGS. 5 and 7, the first coupling member 50 has an annular surrounding portion 53 which is secured on the first outer lateral surface 322, and a central protruding portion 52 which protrudes outwardly and which has three pairs of protrusions 521 and recesses 522 arranged alternately. A pair of blocking members 531 are disposed on the surrounding portion 53. Each blocking member 531 includes a pivot portion 5311 mounted pivotally on the surrounding portion 53 in the axial direction, a coupling end 5312 extending from the pivot portion 5311 and engaging the second cord end 5321 of the cord 532, and a blocking end 5313 extending from the pivot portion 5311 and angularly spaced apart from the coupling end 5312. Thus, by pulling the cord 532, the blocking member 531 can be shifted between a blocking position, where the blocking end 5313 is disposed between the first and second coupling members 50,60, and an unblocked position, where the blocking end 5313 is rotated outwardly of the surrounding portion 53.

Figure 6:
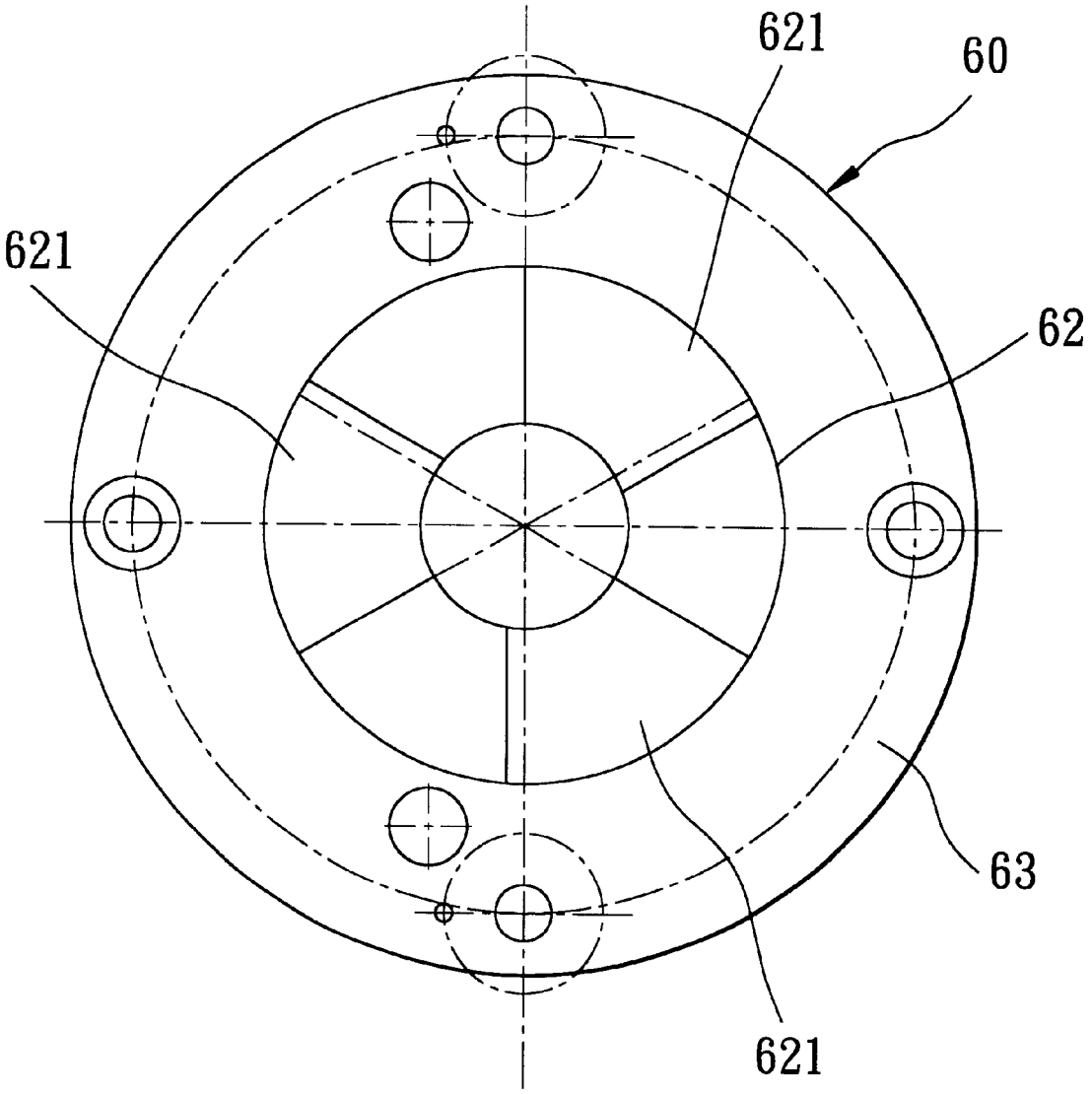
FIG. 6 is a side schematic view of a second coupling member of the embodiment.
Figure 10:
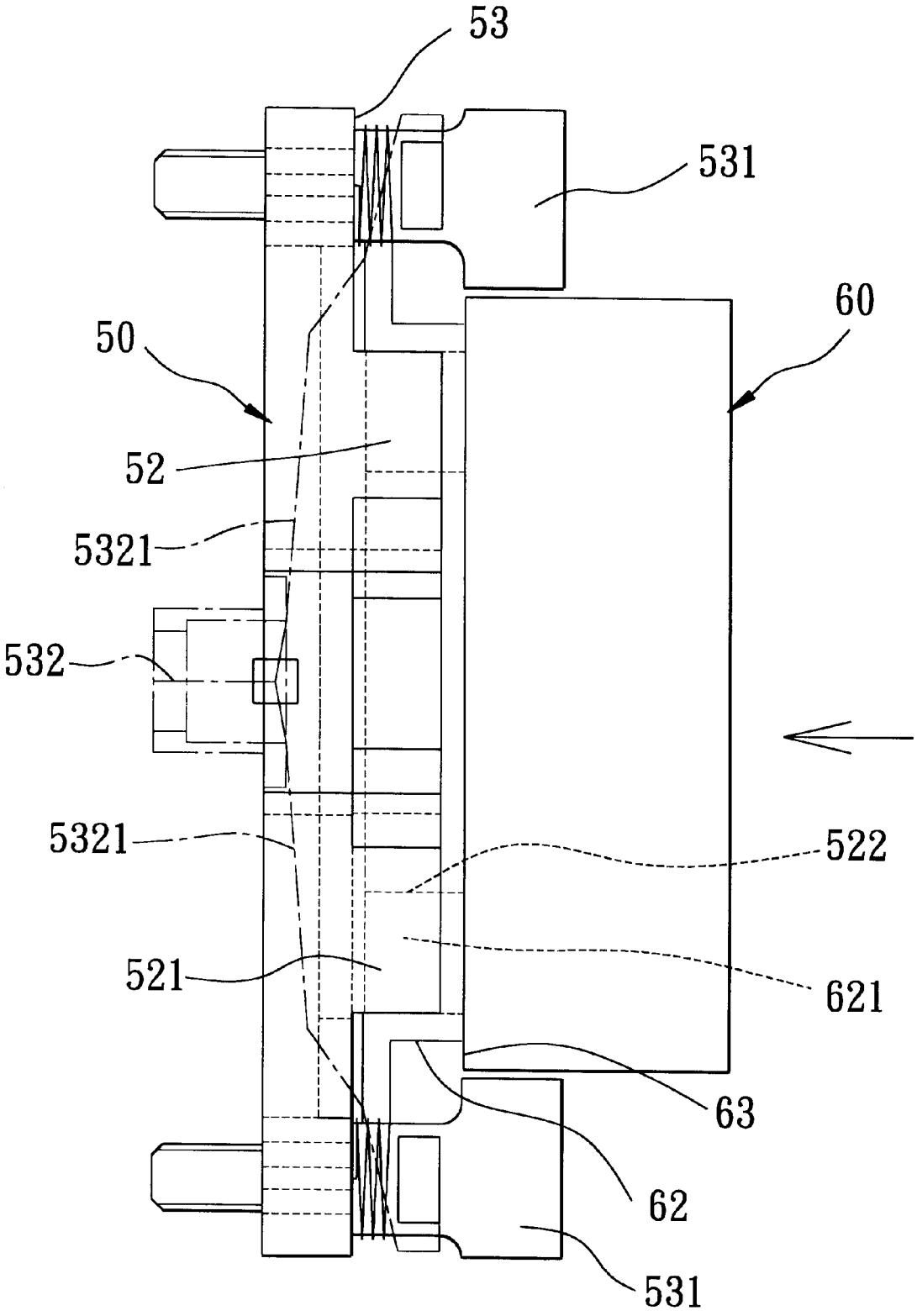
FIG. 10 is a top schematic view showing the engagement between the first and second coupling members.

With reference to FIGS. 6 and 7, the second coupling member 60 is loosely secured on a positioning seat 431 which is secured on the second outer lateral surface 422 to rotate with the second cable drum 40, and is movable along the axis. The second coupling member 60 has an annular surrounding portion 63 which abuts against the blocking members 531, and a central protruding portion 62 with three protrusions 621 which are formed to confront the recesses 522, respectively. A plurality of biasing members 64 are disposed between the positioning seat 431 and the second coupling member 60 to bias the second coupling member 60 toward the first coupling member 50 to an engaging position, where the protrusions 621 engage the corresponding recesses 522 so as to rotate the second cable drum 40 with the first cable drum 30, as shown in FIG. 10.

Return to FIGS. 1 and 2, a guiding mechanism 70 is disposed adjacent to the front wall 15 of the casing 10, and includes a positioning seat 71 which is adapted to be secured on the top wall 81 of the sill 80, a pair of rails 72 which respectively confront the first and second hub portions 31,41 at proximate ends thereof and which extend parallel to each other in a direction radial to the axis at distal ends thereof, and a sliding block 73 with two sliding wheels 731,732 which are slidable respectively along the rails 72 and which permit the first and second leading ends 342,442 of the first and second support cables 34,44 to pass therethrough. Two pulleys 111,112 are secured on the top wall 11 of the casing 10, and are spaced apart from each other in the axial direction such that the first and second leading ends 342,442 pass through the pulleys 111, 112, respectively.

Figure 9:
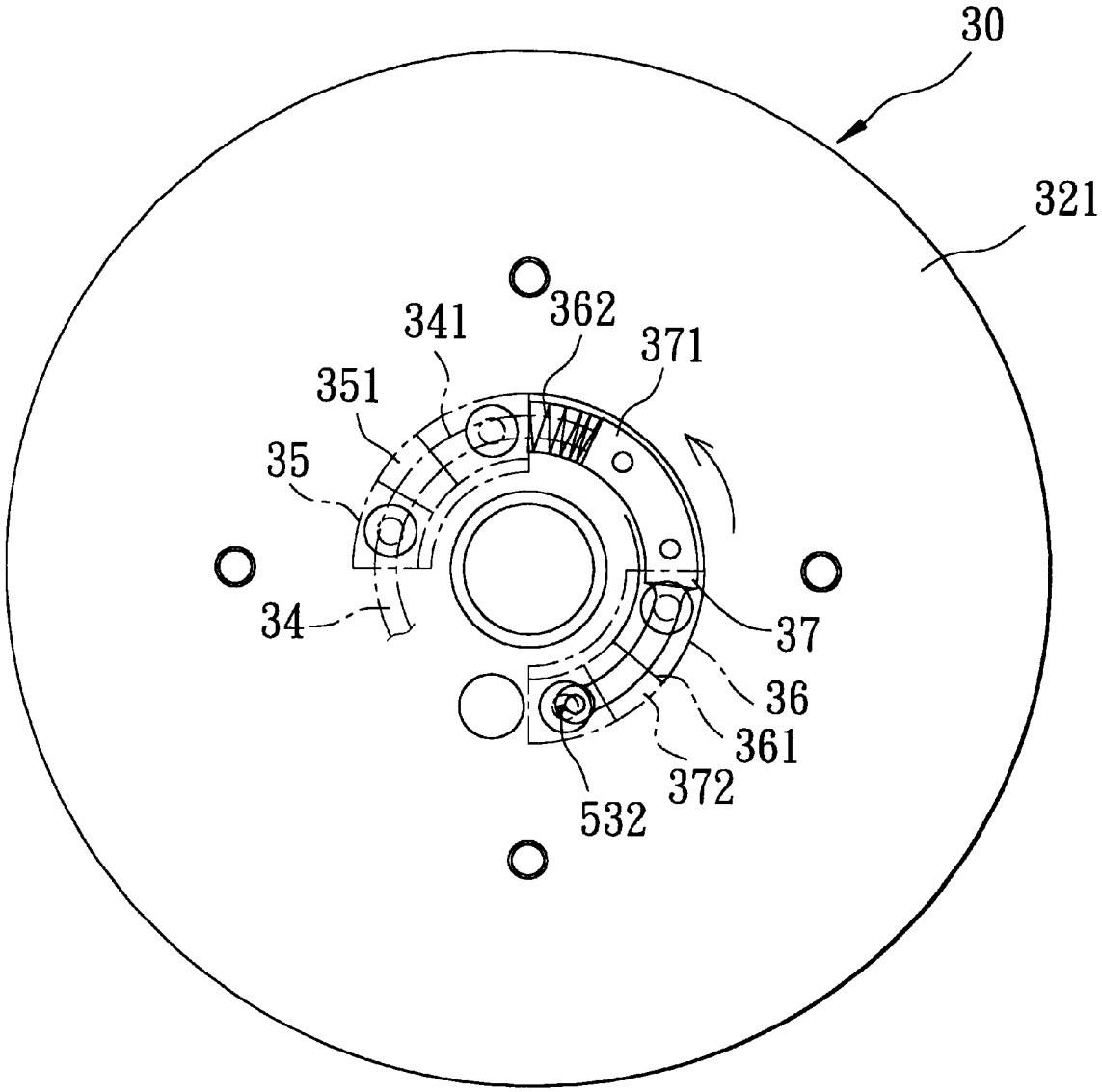
FIG. 9 is a side schematic view similar to FIG. 3 but showing the first cable drum in another state.
Figure 11:
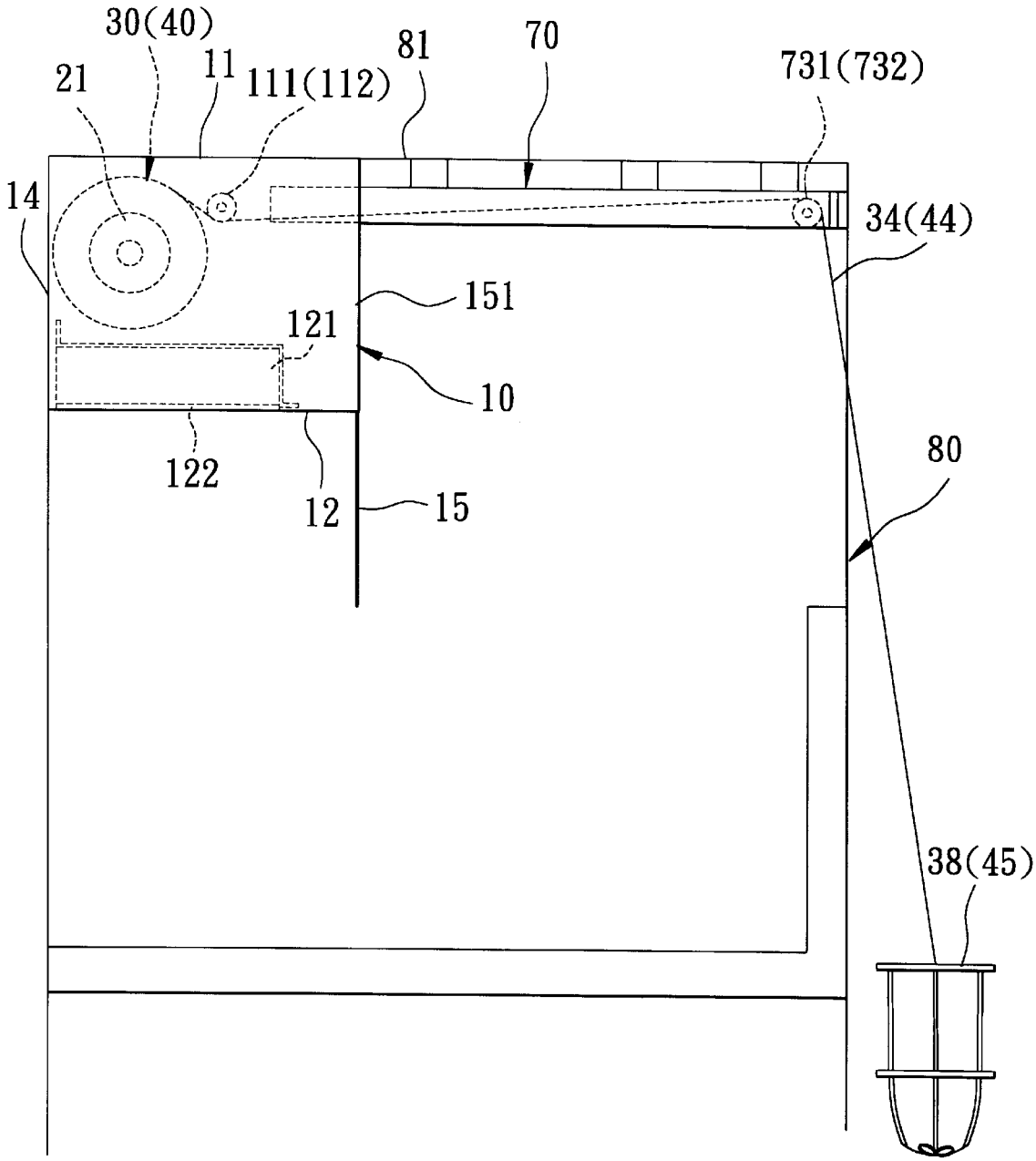
FIG. 11 is a side schematic view showing the embodiment in a state of use.

During an emergency situation, as shown in FIG. 11, the sliding block 73 is pulled to slide along the rails 72 outwardly of the casing 10 via an opening 151 and is retained by a fastening ring 733 which is sleeved on a pin (not shown) and the positioning seat 71. Thus, the first leading end 342 of the first support cable 34 is pulled so that the seat basket 38 is removed from the casing 10. The first person can sit in the seat basket 38, and the first leading end 342 is further pulled so as to unreel the first winding segment to rotate the first cable drum 30 in a clockwise direction, thereby lowering the first person to the safe location at a reduced speed by virtue of the speed reduction mechanism 20. As such, immediately after the first support cable 34 is unreeled from the first wound region, the pulled end 341 will be actuated to generate a jerking force in the axial direction. Referring to FIG. 9, the axial jerking movement of the pulled end 341 can move the connecting head 37 close to the lug seat 35 against the biasing action of the biasing member 362 to pull the cord 532 so as to move the blocking members 531 toward the unblocked position, as indicated by dotted lines in FIG. 5. Therefore, the second coupling member 60 can move in the axial direction to engage the first coupling member 50.

Then, when the next person sits in the seat basket 45, the second leading end 442 of the second support cable 44 is pulled by the next person so as to unreel the second winding segment to rotate the second cable drum 40 in a counterclockwise direction, thereby lowering the next person to the safe location. In this state, due to the engagement between the first and second coupling members 50,60, the first cable drum 30 is rotated with the second cable drum 40 in the counterclockwise direction to reel the first winding segment of the first support cable 34 so as to lift the seat basket 38. By this way, when the third person sits in the seat basket 38 to unreel the first support cable 34 for lowering, the second cable drum 40 is rotated with the first cable drum 30 in the clockwise direction to reel the second support cable 44. To resume movement, alternately and rapidly lowering people one after another from an elevated floor to the safe location can be achieved.

As shown in FIGS. 3 and 7, when the device is not in use, the second coupling member 60 is moved for removal from the first coupling member 50 so as to reel the first support cable 34. The connecting head 37 is moved toward the lug seat 36 by the biasing action of the biasing member 362 to loosen the cord 532 so as to return the blocking members 531 to the blocking position.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A fire escape device adapted to be supported from a portion of a building structure for alternately lowering people one after another from an elevated floor to a safe location during an emergency situation, comprising:

a mounting shaft adapted to be secured relative to the portion of the building structure, said mounting shaft defining an axis and having left and right segments opposite to each other in an axial direction parallel to the axis, and an intermediate segment interposed between said left and right segments;

a first cable drum including a first hub portion rotatably mounted on said left segment, and having first left and right ends opposite to each other in the axial direction, and first left and right sidewalls extending respectively from said first left and right ends outwardly and radially, and spaced apart from each other in the axial direction to confine, together with said first hub portion, a first wound region, said first right sidewall having first inner and outer lateral surfaces opposite to each other in the axial direction;

a first support cable having a first winding segment to be wound around said first hub portion in said first wound region, a first leading end extending from said first winding segment and adapted to be pulled by a first person on the building structure so as to unreel said first winding segment to rotate said first cable drum in a clockwise direction thereby lowering the first person to the safe location, and a pulled end extending from said first winding segment distal to said first leading end, and disposed to be loosely anchored relative to said first inner lateral surface and pullable in the axial direction such that immediately after said first support cable is unreeled from said first wound region, said pulled end will be actuated to generate a jerking force in the axial direction;

a second cable drum including a second hub portion rotatably mounted on said right segment, and having second left and right ends opposite to each other in the axial direction, and second left and right sidewalls extending respectively from said second left and right ends outwardly and radially, and spaced apart from each other in the axial direction to confine, together with said second hub portion, a second wound region, said second left sidewall having second inner and outer lateral surfaces opposite to each other in the axial direction;

a second support cable having a second winding segment to be wound around said second hub portion in said second wound region, a second leading end extending from said second winding segment and adapted to be pulled by a next person on the building structure so as to unreel said second winding segment to rotate said second cable drum in a counterclockwise direction thereby lowering the next person to the safe location, and an anchoring end extending from said second winding segment distal to said second leading end, and disposed to be anchored relative to said second inner lateral surface;

a coupling mechanism including a first coupling member disposed on said first outer lateral surface, and a second coupling member disposed to be loosely secured to and movable relative to said second outer lateral surface in the axial direction so as to be rotated with said second cable drum about the axis, said second coupling member being sleeved on and being movable relative to said intermediate segment in the axial direction between an engaging position where said second coupling member is moved to engage said first coupling member so as to rotate with said first cable drum, and a disengaged position where said second coupling member is retracted to be closer to said second outer lateral surface in the axial direction, thereby disengaging said first coupling member;

a first biasing member disposed between said second coupling member and said second outer lateral surfaces to bias said second coupling member to move to the engaging position; and a blocking member disposed on said first outer lateral surface and movable in response to an axially jerking movement of said pulled end between a blocking position where said blocking member prevents said second coupling member from engaging said first coupling member against the biasing action of said first biasing member, and an unblocked position where said blocking member is steered out of the course which permits the engagement between said first and second coupling members.

2. The fire escape device of claim 1, further comprising a speed reduction gear mechanism disposed between said mounting shaft and said first left sidewall so as to reduce speed of said first cable drum during unreeling of said first support cable.

3. The fire escape device of claim 2, wherein said first inner lateral surface is formed with a through hole extending through said first outer lateral surface, said fire escape device further comprising a connecting head disposed on and movable relative to said first inner lateral surface around the axis to be disposed close to and remote from said through hole, said connecting head having a first connecting end which engages said pulled end and a second connecting end which is displaced angularly opposite to said first connecting end about the axis, a cord having a first cord end engaging said second connecting end, and a second cord end extending through said through hole and engaging said blocking member such that the jerking force is transmitted to said cord via said connecting head to pull said cord so as to move said blocking member toward the unblocked position, and a second biasing member disposed to bias said connecting head to be close to said through hole.

4. The fire escape device of claim 3, wherein said blocking member includes a pivot portion mounted pivotally on said first coupling member distal to said first outer lateral surface in the axial direction, a coupling end extending from said pivot portion and engaging said second cord end, and a blocking end extending from said pivot portion and angularly spaced apart from said coupling end and disposed between said first and second coupling members to place said blocking member in the blocking position, and such that the jerking force transmitted by said cord actuates swinging of said blocking end to place said blocking member in the unblocked position to permit engagement between said first and second coupling members.

5. The fire escape device of claim 4, wherein said first coupling member has a plurality of recesses angularly displaced therein about the axis and concaved in the axial direction, said second coupling member having a plurality of protrusions angularly displaced thereon about the axis and confronting said recesses respectively so as to engage said recesses when said blocking member is in the unblocked position.

6. The fire escape device of claim 1, further comprising two seat baskets connected to said first and second leading ends, respectively, for accommodating the people.

7. The fire escape device of claim 6, further comprising two rails having proximate ends respectively confronting said first and second hub portions and distal ends extending parallel to each other in a direction radial to the axis, and two sliding wheels slidable respectively along said rails and respectively permitting said first and second leading ends to pass therethrough for unreeling of said first and second winding segments, respectively.

8. The fire escape device of claim 7, further comprising two pulleys adapted to be mounted on the portion of the building structure and spaced apart from each other in the axial direction such that said first and second leading ends pass through said pulleys, respectively.

9. The fire escape device of claim 1, further comprising an illuminating member adapted to be mounted on the portion of the building structure.

* * * * *